US010597245B2

(12) United States Patent
Takashima

(10) Patent No.: US 10,597,245 B2
(45) Date of Patent: Mar. 24, 2020

(54) IMAGE FORMING APPARATUS AND PAPER FEEDING METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Kenji Takashima, Numazu Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/059,153

(22) Filed: Aug. 9, 2018

(65) Prior Publication Data

US 2018/0346272 A1 Dec. 6, 2018

Related U.S. Application Data

(63) Continuation of application No. 15/466,048, filed on Mar. 22, 2017, now Pat. No. 10,081,509.

(51) Int. Cl.

| | |
|---|---|
| ***B65H 9/00*** | (2006.01) |
| ***B65H 1/26*** | (2006.01) |
| ***B65H 3/06*** | (2006.01) |
| ***B65H 3/42*** | (2006.01) |
| ***B65H 3/60*** | (2006.01) |
| ***G03G 15/00*** | (2006.01) |
| ***B65H 3/56*** | (2006.01) |

(52) U.S. Cl.

CPC ..... *B65H 9/002* (2013.01); *B65H 1/266* (2013.01); *B65H 3/06* (2013.01); *B65H 3/0669* (2013.01); *B65H 3/0676* (2013.01); *B65H 3/0684* (2013.01); *B65H 3/42* (2013.01); *B65H 3/56* (2013.01); *B65H 3/60* (2013.01);

(Continued)

(58) Field of Classification Search

CPC ..... B65H 3/06; B65H 3/0638; B65H 3/0646; B65H 3/0676; B65H 3/0684; B65H 3/28; B65H 3/42; B65H 3/60; B65H 7/00; B65H 7/18; B65H 7/20; B65H 2301/3114;

(Continued)

(56) References Cited

U.S. PATENT DOCUMENTS 3,666,262 A * 5/1972 Fowler ..... G06K 13/07 271/251
4,270,745 A * 6/1981 Woodard ..... B65H 3/0646 271/117

(Continued)

FOREIGN PATENT DOCUMENTS

JP 2012-091914 5/2012

OTHER PUBLICATIONS

Non-Final Office Action for U.S. Appl. No. 15/466,048 dated Sep. 19, 2017.

(Continued)

*Primary Examiner* — Prasad V Gokhale

(74) *Attorney, Agent, or Firm* — Amin, Turocy & Watson, LLP

(57) ABSTRACT

According to one embodiment, an image forming apparatus includes an accommodation unit and at least one driving roller. The accommodation unit accommodates a paper sheet therein. The at least one driving roller is disposed contactably with the paper sheet. A rotation direction of the at least one driving roller with respect to the paper sheet at a contact part between the paper sheet and the roller intersects a carrying direction of the paper sheet.

16 Claims, 8 Drawing Sheets

(52) U.S. Cl.
CPC ..... *G03G 15/6511* (2013.01); *G03G 15/6529* (2013.01); *B65H 2301/3114* (2013.01); *B65H 2301/3412* (2013.01); *B65H 2301/5121* (2013.01); *B65H 2403/514* (2013.01); *B65H 2404/1315* (2013.01); *B65H 2404/1371* (2013.01); *B65H 2404/152* (2013.01); *B65H 2405/114* (2013.01); *B65H 2801/06* (2013.01)

(58) Field of Classification Search
CPC .... B65H 2301/3412; B65H 2301/5121; B65H 2404/1371
See application file for complete search history.

(56) References Cited

U.S. PATENT DOCUMENTS 5,507,482 A * 4/1996 Tenpaku ..... B65H 9/166 271/251
7,905,484 B2 * 3/2011 Komuro ..... B65H 3/0684 271/10.03
2005/0140078 A1 * 6/2005 Fujiwara ..... B65H 3/06 271/9.01
2006/0261542 A1 * 11/2006 Collings ..... B65H 3/0676 271/265.04
2010/0066007 A1 * 3/2010 Muller ..... B65H 5/24 271/90
2012/0103759 A1 * 5/2012 Koo ..... B65H 5/062 198/611
2015/0166275 A1 * 6/2015 Sato ..... B65H 3/0669 271/264
2016/0055700 A1 * 2/2016 Wang ..... G07F 19/202 271/314
2016/0334747 A1 * 11/2016 Wakabayashi ..... B65H 1/24

OTHER PUBLICATIONS

Final Office Action for U.S. Appl. No. 15/466,048 dated Feb. 1, 2018.

* cited by examiner

IMAGE FORMING APPARATUS AND PAPER FEEDING METHOD

CROSS-REFERENCE TO RELATED APPLICATION

This application is a Continuation of application Ser. No. 15/466,048 filed on Mar. 22, 2017, the entire contents of which are incorporated herein by reference.

FIELD

Embodiments described herein relate generally to an image forming apparatus and a paper feeding method.

BACKGROUND

In recent years, in a paper feeding unit of an image forming apparatus, a pickup roller carries a paper sheet.

However, in this configuration, there is a case where a number of paper sheets which cannot be separated is carried, and thus multiple feeding occurs.

DETAILED DESCRIPTION

Figure 1:
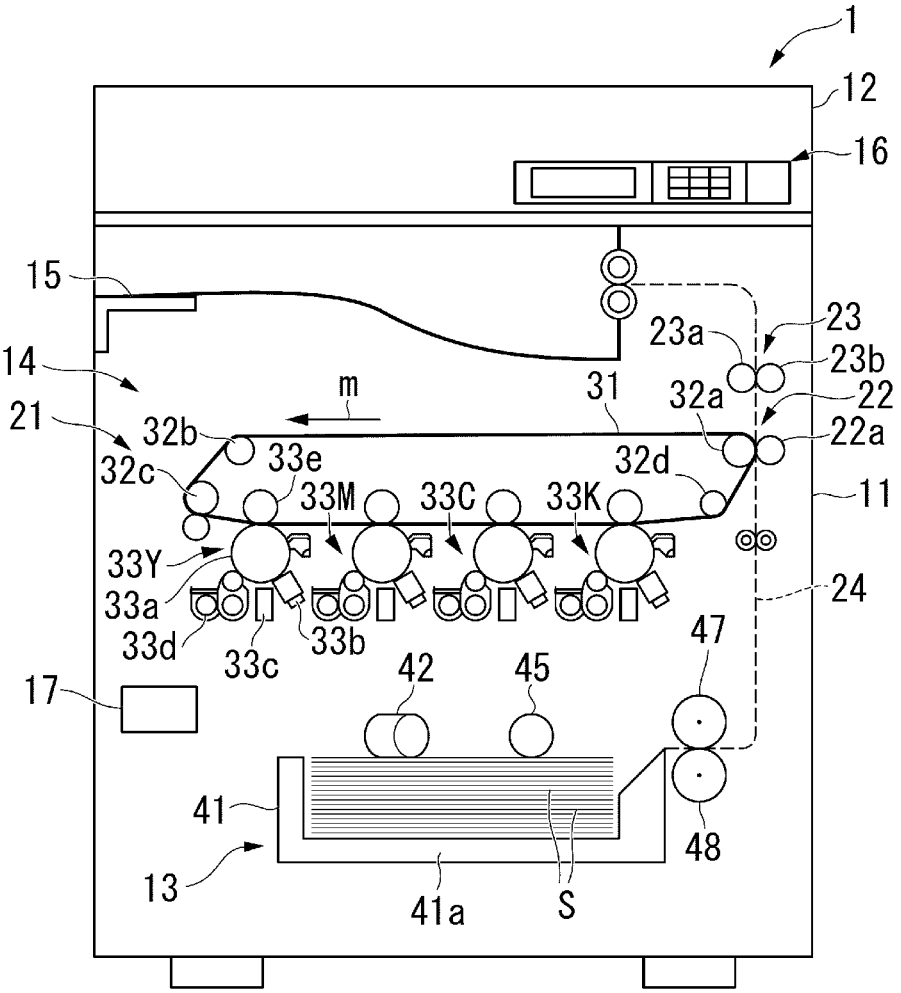
FIG. 1 is a front view illustrating the entire configuration of an image forming apparatus according to a first embodiment.

In general, according to one embodiment, an image forming apparatus includes an accommodation unit and at least one driving roller. The accommodation unit accommodates a paper sheet therein. The at least one driving roller is disposed contactably with the paper sheet. A rotation direction of the at least one driving roller with respect to the paper sheet at a contact part between the paper sheet and the roller intersects a carrying direction of the paper sheet.

Hereinafter, with reference to the drawings, a description will be made of an image forming apparatus and a paper feeding method of embodiments. In the following description, constituent elements having the same or similar function are given the same reference numerals. Repeated description of the constituent elements will be omitted in some cases. In the present embodiment, an "upper side" and a "lower side" in a paper sheet S are directions with a state in which the paper sheet S is accommodated in a paper feeding cassette 41 of an image forming apparatus 1 as a reference. A "left side" and a "right side" in the paper sheet S respectively indicate a "left side" and "right side" as a result of the paper sheet S being divided into both sides with respect to a central line which is substantially parallel to a carrying direction X of the paper sheet S.

First Embodiment

FIG. 1 is a front view illustrating the entire configuration of the image forming apparatus 1 according to the first embodiment. For example, the image forming apparatus 1 is a multifunction peripheral (MFP). However, the image forming apparatus 1 is not limited to the above-described example, and may be a copier, a printer, or the like.

As illustrated in FIG. 1, the image forming apparatus 1 includes a casing 11, a scanner unit 12, a paper feeding unit 13, a printer unit 14, a paper discharge unit 15, a control panel 16, and a control unit 17.

The casing 11 forms an outer frame of the image forming apparatus 1. The casing 11 accommodates the scanner unit 12, the paper feeding unit 13, the printer unit 14, and the control unit 17 therein.

The scanner unit 12 reads image information of an original document as digital data.

The paper feeding unit 13 feeds a paper sheet S toward the printer unit 14.

The printer unit 14 forms an image on the paper sheet S on the basis of the image data.

The paper discharge unit 15 discharges the paper sheet S on which the image is formed by the printer unit 14.

The control panel 16 receives input of various operation instructions.

The control unit 17 controls the entire image forming apparatus 1. For example, the control unit 17 controls operations of the scanner unit 12, the paper feeding unit 13, the printer unit 14, and the control panel 16.

Next, a description will be made of a configuration of each unit of the image forming apparatus 1.

First, the printer unit 14 will be described.

In the present embodiment, for convenience of description, an intermediate transfer type printer unit 14 will be described as an example. However, the configuration of the present embodiment is applicable to an image forming apparatus provided with a direct transfer type printer unit. The printer unit 14 includes an intermediate transfer portion (primary transfer portion) 21, a secondary transfer portion 22, a fixing device 23, and a carrying path 24.

The intermediate transfer portion 21 includes an intermediate transfer belt 31, a plurality of rollers 32*a*, 32*b*, 32*c* and 32*d*, and a plurality of image forming sections 33Y, 33M, 33C and 33K.

The intermediate transfer belt 31 is formed in an endless manner. The plurality of rollers 32*a*, 32*b*, 32*c* and 32*d* support the intermediate transfer belt 31. Consequently, the intermediate transfer belt 31 can travel endlessly in a direction indicated by an arrow m in FIG. 1.

The plurality of image forming sections 33Y, 33M, 33C and 33K includes a yellow image forming section 33Y, a magenta image forming section 33M, a cyan image forming section 33C, and a black image forming section 33K. Each of the image forming sections 33Y, 33M, 33C and 33K includes a photoconductive drum 33*a*, a charger 33*b*, an exposure device 33*c*, a developer 33*d*, and a transfer roller 33*e*. Each of the image forming sections 33Y, 33M, 33C and 33K transfers (primarily transfers) a toner image formed on a surface of the photoconductive drum 33*a* onto the intermediate transfer belt 31.

The secondary transfer portion 22 includes a transfer roller 22*a*. The transfer roller 22*a* is in contact with an outer surface of the intermediate transfer belt 31. The belt roller 32*a* as one of the rollers supporting the intermediate transfer belt 31 is included in constituent elements of the secondary transfer portion 22. The paper sheet S is nipped between the transfer roller 22*a* and the belt roller 32*a* along with the intermediate transfer belt 31. Consequently, the toner image on the intermediate transfer belt 31 is transferred (secondarily transferred) onto the paper sheet S.

The fixing device 23 includes a heat roller 23*a* and a press roller 23*b*. The fixing device 23 heats and presses the paper sheet S passing between the heat roller 23*a* and the press roller 23*b*. Consequently, the toner image transferred onto the paper sheet S is fixed to the paper sheet S.

The carrying path 24 reaches the paper discharge unit 15 from the paper feeding unit 13 through the secondary transfer portion 22 and the fixing device 23. The paper sheet S is carried along the carrying path 24 so as to be moved from the paper feeding unit 13 to the paper discharge unit 15 through the secondary transfer portion 22 and the fixing device 23.

Next, the control unit 17 will be described.

Figure 2:
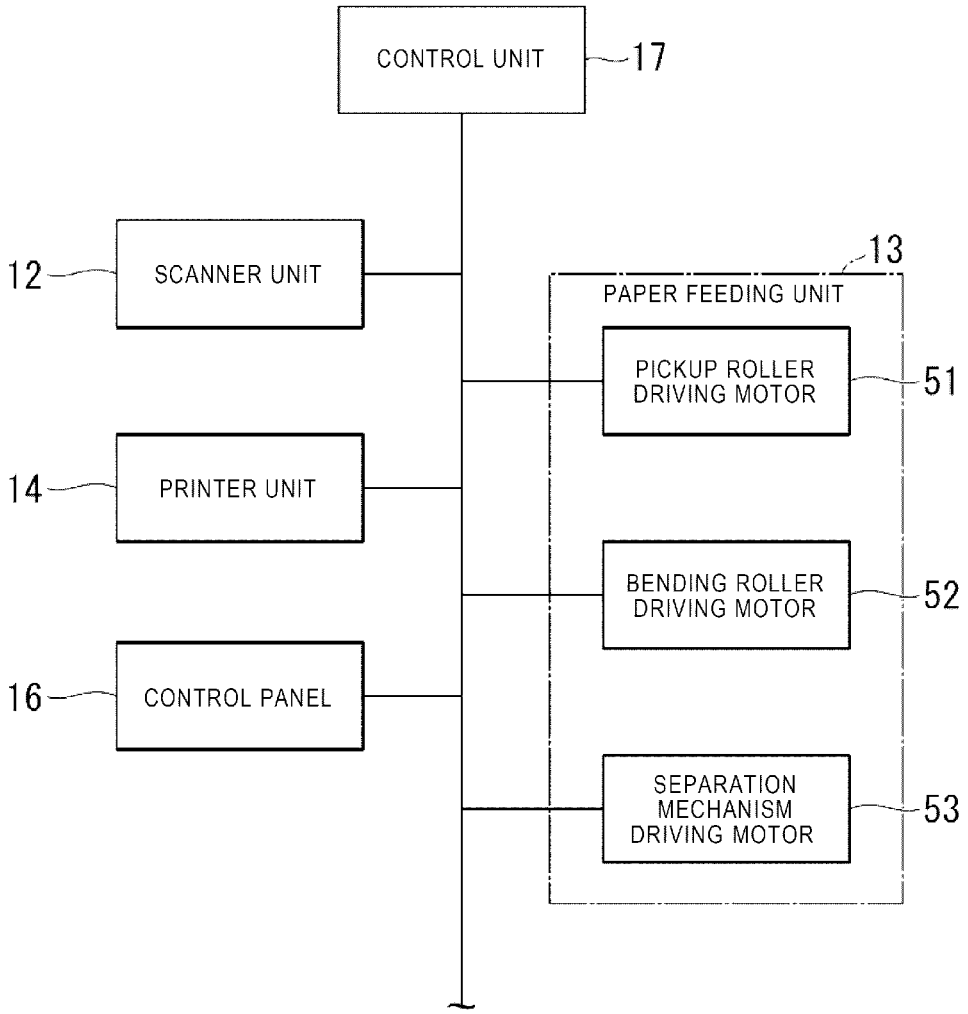
FIG. 2 is a block diagram illustrating a system configuration of the apparatus.

FIG. 2 is a block diagram illustrating a system configuration of the image forming apparatus 1.

As illustrated in FIG. 2, the control unit 17 is electrically connected to the scanner unit 12, the paper feeding unit 13, the printer unit 14, and the control panel 16, via an electrical connection path such as a cable. As will be described later, the control unit 17 can control respective driving sources corresponding to constituent elements of the paper feeding unit 13.

A part or the whole of the control unit 17 is a software functional unit which is realized, for example, by a processor (hardware processor) such as a central processing unit (CPU) executing a program (software component) stored in a memory of the image forming apparatus 1. A part or the whole of the control unit 17 may be realized by hardware such as a large scale integration (LSI), an application specific integrated circuit (ASIC), or a field programmable gate array (FPGA), and may be realized by a combination of a software functional unit and hardware.

Next, the paper feeding unit 13 will be described.

Figure 3:
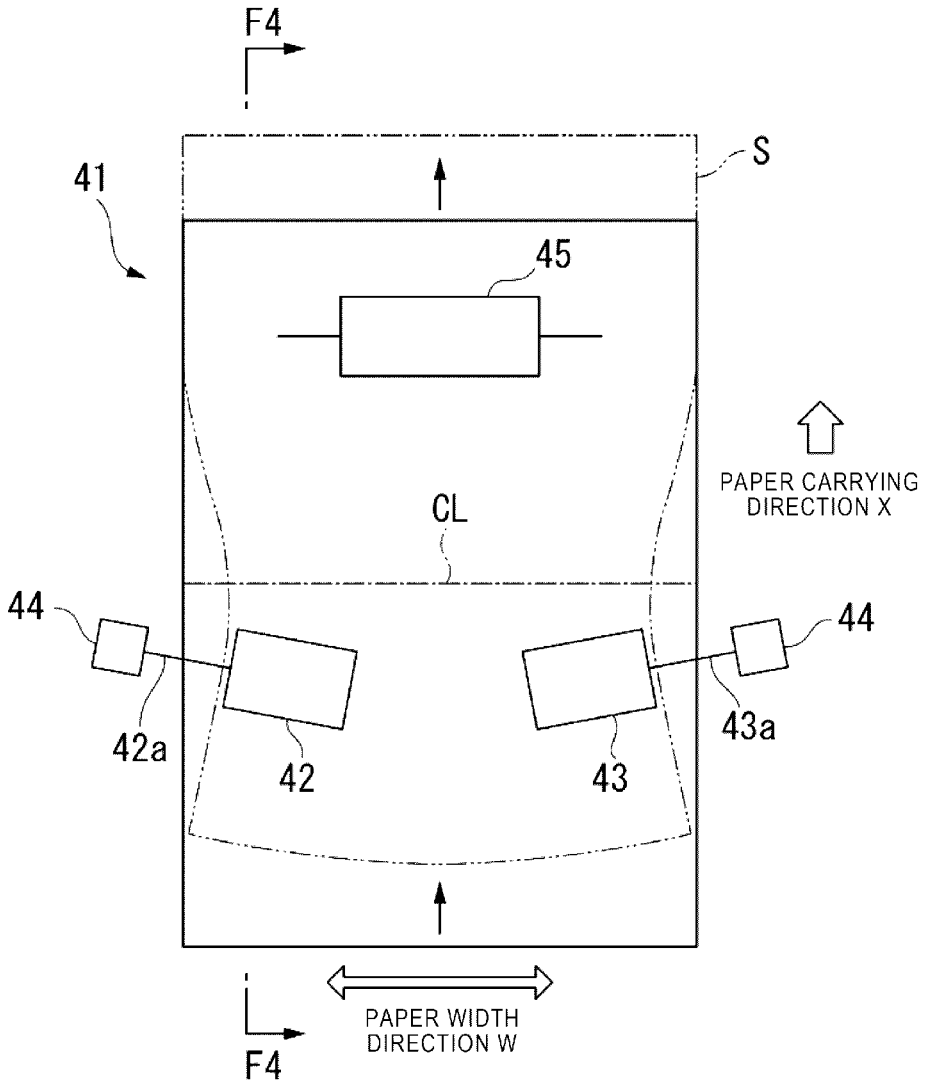
FIG. 3 is a plan view illustrating a paper feeding unit of the apparatus.
Figure 4:
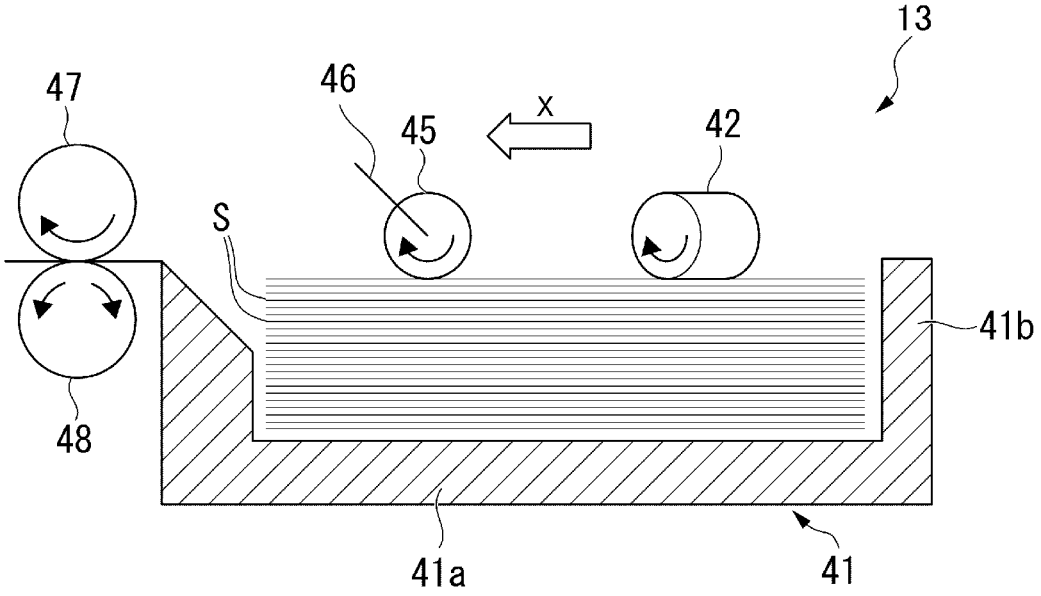
FIG. 4 is a sectional view taken along the F4-F4 line of the unit.

FIG. 3 is a plan view illustrating the paper feeding unit 13. FIG. 4 is a sectional view illustrating the paper feeding unit 13.

As illustrated in FIGS. 3 and 4, the paper feeding unit 13 includes a paper feeding cassette 41, a paper feeding roller 47, a separation roller 48, a pickup roller 45, a pickup roller driving mechanism 46, a first bending roller 42, a second bending roller 43, and a separation mechanism 44.

The paper feeding cassette 41 is an example of an "accommodation unit". The paper feeding cassette 41 is attached to the casing 11 so as to be extractable therefrom. The paper feeding cassette 41 has a bottom wall 41*a* and a sidewall 41*b* standing from a peripheral edge of the bottom wall 41*a*. Consequently, the paper feeding cassette 41 is formed in a state in which an upper part thereof is open. The paper feeding cassette 41 can accommodate the paper sheets S on which images are printed therein.

The paper feeding roller 47 and the separation roller 48 are disposed further toward the downstream side than the paper feeding cassette 41 in the paper carrying direction X. Each of the paper feeding roller 47 and the separation roller 48 is driven by a driving source (for example, a motor) (not illustrated). The paper feeding roller 47 sends the paper sheet S which is fed from the paper feeding cassette 41, to the carrying path 24. If two paper sheets S are to be carried from the paper feeding cassette 41, the separation roller 48 returns the lower paper sheet S of the two paper sheets S to the paper feeding cassette 41.

The pickup roller 45 is disposed over the paper feeding cassette 41. The pickup roller 45 is driven by a pickup roller driving motor 51 (refer to FIG. 2). The pickup roller 45 sends the paper sheets S accommodated in the paper feeding cassette 41 toward the paper feeding roller 47.

The pickup roller driving mechanism 46 retracts the pickup roller 45 upward if the paper feeding cassette 41 is extracted from the casing 11. On the other hand, if the paper feeding cassette 41 is closed with respect to the casing 11, the pickup roller driving mechanism 46 moves down the pickup roller 45 toward the paper sheets S.

The first bending roller 42 and the second bending roller 43 are disposed above the paper feeding cassette 41. The first bending roller 42 and the second bending roller 43 are disposed further toward the upstream side than the pickup roller 45 in the paper carrying direction X. The first bending roller 42 and the second bending roller 43 are driven by the driving source such as a bending roller driving motor 52 (refer to FIG. 2). The driving source may be a plurality of driving sources which drive the first bending roller 42 and the second bending roller 43 separately from each other, and may be a single driving source configured to drive both of the first bending roller 42 and the second bending roller 43. For example, the first bending roller 42 and the second bending roller 43 may be connected to each other via a universal joint so as to be driven in conjunction with each other by a single driving source. The first bending roller 42 and the second bending roller 43 are examples of at least one driving roller. The first bending roller 42 is an example of a "first roller". The second bending roller 43 is an example of a "second roller".

Next, functions of the first bending roller 42 and the second bending roller 43 will be described.

As illustrated in FIG. 3, the first bending roller 42 and the second bending roller 43 are disposed with respect to the paper feeding cassette 41 so that a rotation direction of each of the first bending roller 42 and the second bending roller 43 with respect to the paper sheet S intersects the carrying direction X of the paper sheet S. Here, the "rotation direction of each of the rollers with respect to the paper sheet" indicates a rotation direction of the roller at a contact part between the paper sheet S and the roller. In other words, the "rotation direction of each of the rollers with respect to the paper sheet" indicates a direction in which the roller causes a force to act on the paper sheet S. In other words of the description, the first bending roller 42 and the second bending roller 43 are disposed so that a rotation shaft 42*a* of the first bending roller 42 and a rotation shaft 43*a* of the second bending roller 43 intersect each other with respect to a paper width direction W. The paper width direction W is a direction which is substantially orthogonal to the carrying direction X of the paper sheet S.

When the paper sheet S is carried, the first bending roller 42 and the second bending roller 43 are driven to come into contact with the uppermost paper sheet S among a plurality of paper sheets S accommodated in the paper feeding cassette 41. In other words, the first bending roller 42 and the second bending roller 43 come into contact with the paper sheet S from the substantially same direction as the pickup roller 45. Here, the term "coming into contact with the paper sheet when the paper sheet is carried" is not limited to a case where the rollers come into contact with the paper sheet S in the middle of carrying of the paper sheet S, and includes a case where the rollers come in contact with the paper sheet S before carrying of the paper sheet S is started, and are separated from the paper sheet S at the substantially same time as carrying of the paper sheet S being started by the pickup roller 45. Each of the first bending roller 42 and the second bending roller 43 applies a force to the paper sheet S so that at least a part of the paper sheet S is moved in the rotation directions of the first bending roller 42 and the second bending roller 43.

In FIG. 3, the rotation directions of the first bending roller 42 and the second bending roller 43 intersect both of the carrying direction X and the paper width direction W. Therefore, the first bending roller 42 and the second bending roller 43 apply a force directed toward the right side to the left half of the paper sheet S, and apply a force directed toward the left side to the right half of the paper sheet S while applying forces in the carrying direction X. As a result, a central part of the paper sheet S in the paper width direction W becomes bent upward. Here, the term "becoming bent" indicates that at least a part of a paper sheet S disposed in a plane state becomes deformed to form a curved surface. The term "bending" indicates deforming at least a part of a paper sheet S disposed in a plane state in order to form a curved surface.

As indicated by a two-dot chain line in FIG. 3, the paper sheet S becomes bent upward by the first bending roller 42 and the second bending roller 43, and is then sent in the carrying direction X by the pickup roller 45 at the substantially same time as becoming bent. In other words, when the paper sheet S is carried, at least a part of the uppermost paper sheet S in the paper feeding cassette 41 floats from another paper sheet S by the first bending roller 42 and the second bending roller 43. Therefore, the paper feeding unit 13 of the present embodiment can prevent a plurality of paper sheets S from being simultaneously carried due to static electricity, friction, or the like acting between the paper sheets S. This reduces a probability that multiple feeding of the paper sheets S may occur.

In order to achieve such an effect, the first bending roller 42 and the second bending roller 43 may not be disposed as in FIG. 3. In other words, the bending rollers 42 and 43 may be provided on the paper feeding cassette 41 in any arrangement as long as the bending rollers 42 and 43 bend a part of the paper sheet S.

Specifically, at least one bending roller may be disposed on the paper feeding cassette 41 so that a rotation direction of the roller with respect to the paper sheet S intersects the carrying direction X of the paper sheet S. A force applied to the paper sheet S by the bending roller includes not only a component in the carrying direction X but also a component in the paper width direction W. Thus, the paper sheet S is applied with the force in the paper width direction W and thus becomes bent in the paper width direction W.

A bent position of the paper sheet S is not limited to the central part of the paper sheet S in the paper width direction W. The bending roller may bend an end of the paper sheet S. Parts other than the central part and the end may be bent.

In the present embodiment, the first bending roller 42 and the second bending roller 43 are disposed substantially symmetric to each other with respect to the carrying direction X (refer to FIG. 3). In this case, a sum (combined force) of forces applied to the paper sheet S from the first bending roller 42 and the second bending roller 43 are parallel to the carrying direction X. This is because, if the forces are added together, components in the paper width direction W cancel out each other, and thus only components in the carrying direction X remain. Thus, the first bending roller 42 and the second bending roller 43 can not only bend the paper sheet S but also send the paper sheet S in the carrying direction X. Therefore, it is possible to more reliably prevent multiple feeding of the paper sheets S by bending the paper sheet S without greatly changing constituent elements of the related art other than the first bending roller 42 and the second bending roller 43. In this case, the first bending roller 42 and the second bending roller 43 can also function as the pickup roller 45, and thus the pickup roller 45 may be omitted.

If the first bending roller 42 and the second bending roller 43 are disposed to be substantially symmetric to each other with respect to the carrying direction X, bending of the paper sheet S may occur substantially in symmetry with respect to the carrying direction X. Thus, when the paper sheet S becomes bent and is then carried, positioning (particularly, in the paper width direction W) of the paper sheet S can be performed more accurately.

In the present embodiment, the first bending roller 42 and the second bending roller 43 are disposed so that the rotation shaft 42*a* of the first bending roller 42 and the rotation shaft 43*a* of the second bending roller 43 are separated from each other toward the downstream side in the carrying direction X (refer to FIG. 3). In this case, since the paper sheet S is applied with forces inward in the paper width direction W from the first bending roller 42 and the second bending roller 43, bending of the paper sheet S occurs around the central part in the paper width direction W. This can prevent the paper sheet S from splitting due to forces being applied outward in the paper width direction W from the rollers. The first bending roller 42 and the second bending roller 43 also apply forces to the paper sheet S in the carrying direction X, the paper sheet S can be bent and be also sent in the carrying direction X.

As described above, if the first bending roller 42 and the second bending roller 43 have a function of sending the paper sheet S in the carrying direction X, the pickup roller 45 may be omitted. However, in the present embodiment, the paper feeding unit 13 is provided with both of the first bending roller 42 and the second bending roller 43 for bending the paper sheet S and the pickup roller 45 for sending the paper sheet S in the carrying direction X. In this case, the first bending roller 42 and the second bending roller 43 bend the paper sheet S, and then the pickup roller 45 forwards the paper sheet S toward the paper feeding roller 47 on the downstream side in the carrying direction X while extending the paper sheet S to become flat. Consequently, it is possible to carry the paper sheet S at a higher speed and with higher accuracy.

For example, if the pickup roller 45 is provided, the first bending roller 42 and the second bending roller 43 are disposed further toward the upstream side in the carrying direction X than a central line CL of the paper sheet S in the carrying direction X. In this arrangement, a region where bending occurs between the pickup roller 45 and the first bending roller 42 and the second bending roller 43 is wide, and thus it is possible to reduce a probability that a wrinkle or a fold of the paper sheet S may be formed due to bending.

In FIG. 3, rotation directions of the first bending roller 42 and the second bending roller 43 are inclined with respect to the carrying direction X, but the first bending roller 42 and the second bending roller 43 may be disposed so that rotation directions thereof are substantially perpendicular to the carrying direction X. In this case, the rotation shaft 42*a* of the first bending roller 42 and the rotation shaft 43*a* of the second bending roller 43 are substantially parallel to the carrying direction X. In this configuration, the first bending roller 42 and the second bending roller 43 do not apply forces to the paper sheet S in the carrying direction X, and thus a constituent element such as the pickup roller 45 sending the paper sheet S in the carrying direction X may be provided separately. The paper sheet S is applied with forces in the paper width direction W from the first bending roller 42 and the second bending roller 43, and is applied with a force in the carrying direction X from the pickup roller 45. The forces in the paper width direction W and the force in the carrying direction X can be applied to the paper sheet S separately, and thus paper feeding can be easily controlled.

Any material of the roller may be selected from among known materials in the related art as necessary. For example, a roller such as a rubber roller made of a material having considerable friction may be used.

For example, a diameter and a width of the roller, an angle thereof with respect to the carrying direction X, and a rotation speed may be set as appropriate.

Figure 5A:
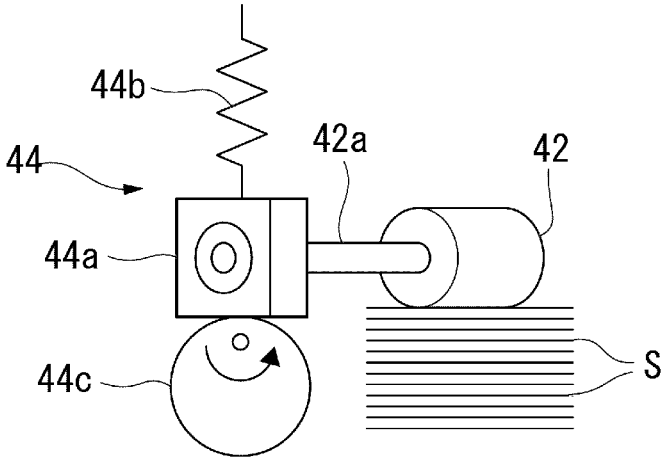
FIG. 5A is a diagram illustrating a separation mechanism of the unit.
Figure 5B:
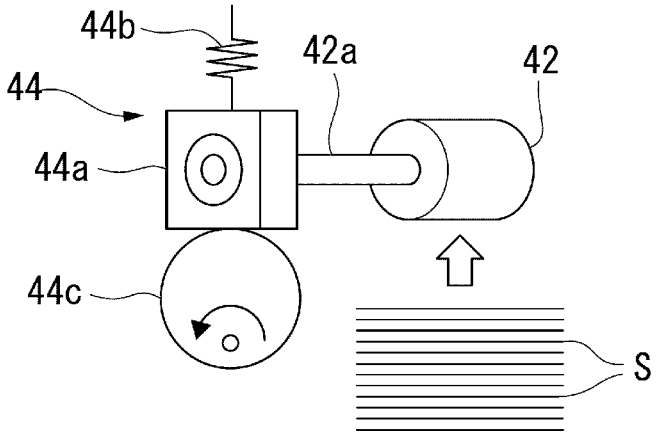
FIG. 5B is a diagram illustrating the separation mechanism of the unit.

FIGS. 5A and 5B are diagrams illustrating the separation mechanism 44 of the paper feeding unit 13.

The separation mechanism 44 moves the first bending roller 42 between a contact position (refer to FIG. 5A) where the first bending roller 42 comes into contact with the paper sheet S and a separation position (refer to FIG. 5B) where the first bending roller 42 is separated from the paper sheet S. FIGS. 5A and 5B illustrate the first bending roller 42, but the same separation mechanism 44 may be provided for the second bending roller 43.

In the present embodiment, the separation mechanism 44 includes a biasing member 44*b* which biases a support 44*a* supporting the rotation shaft 42*a* of the first bending roller 42, an eccentric cam 44*c* in contact with the support 44*a*, and a separation mechanism driving motor 53 (refer to FIG. 2) driving the eccentric cam 44*c*.

As illustrated in FIG. 5A, the biasing member 44*b* (for example, a spring) of the separation mechanism 44 biases the support 44*a* and the first bending roller 42 downward (paper sheet S). The first bending roller 42 is pressed against the paper sheet S by the biasing force at the contact position.

On the other hand, at the separation position illustrated in FIG. 5B, the eccentric cam 44*c* of the separation mechanism 44 is rotated, and thus an upward force is applied to the support 44*a*. As a result, the support 44*a* and the first bending roller 42 can be lifted upward so as to be separated from the paper sheet S. At this time, the biasing member 44*b* is shrinked more than at the contact position.

The separation mechanism 44 can cause the first bending roller 42 and the second bending roller 43 to switch between the contact position and the separation position as necessary.

If the paper sheet S becomes temporarily bent, static electricity between the paper sheets S which may cause multiple feeding of the paper sheets S is reduced. On the other hand, in order to easily carry the paper sheet S, after the paper sheet S becomes bent the first bending roller 42 and the second bending roller 43 may be separated from the paper sheet S so that the paper sheet S returns to a state in which bending of the paper sheet S is slight or the paper sheet S is not bent. The separation mechanism 44 separates the first bending roller 42 and the second bending roller 43 from the paper sheet S after the paper sheet S becomes bent, and can thus easily carry the paper sheet S. For example, the first bending roller 42 and the second bending roller 43 are separated from the paper sheet S by the separation mechanism 44, and then the paper sheet S is sent in the carrying direction X by the pickup roller 45 and the like.

In the present embodiment, the separation mechanism 44 includes the biasing member 44*b* and the eccentric cam 44*c*, but a configuration of the separation mechanism 44 is not limited to the illustrated configuration. Any separation mechanism 44 may be employed as long as the separation mechanism 44 can move the first bending roller 42 and the second bending roller 43 between the contact position and the separation position. For example, the separation mechanism 44 may be a link mechanism not including a cam, and may be a crank mechanism or a rack and pinion mechanism.

The pickup roller 45 is normally brought into contact with the paper sheet S by the pickup roller driving mechanism 46 when the paper feeding cassette 41 is accommodated in the casing 11.

Figure 6:
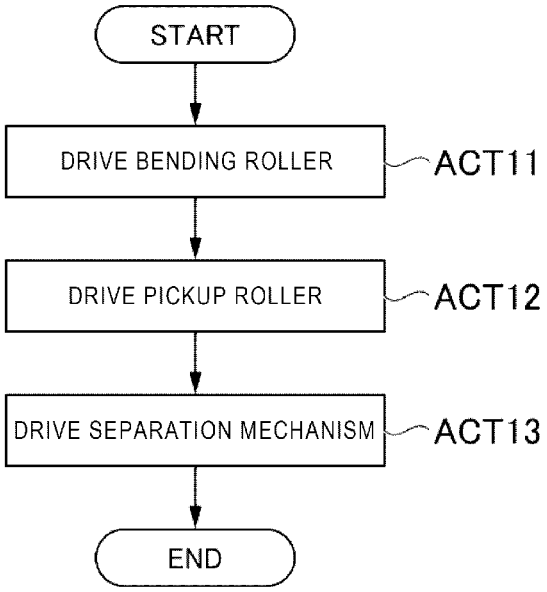
FIG. 6 is a flowchart illustrating an example of a process flow in a control unit.

FIG. 6 is a flowchart illustrating an example of a process flow in the control unit 17. The control unit 17 is configured to control a first driving source (bending roller driving motor 52) driving the first bending roller 42 and the second bending roller 43, a second driving source (pickup roller driving motor 51) driving the pickup roller 45, and a third driving source (separation mechanism driving motor 53) driving the separation mechanism 44 (refer to FIG. 2). The control unit 17 may control timings for driving the above-described constituent elements as necessary. For example, as illustrated in FIG. 6, the control unit 17 may control the first driving source, the second driving source, and the third driving source, so as to first drive the first bending roller 42 and the second bending roller 43 (ACT 11), next, drive the pickup roller 45 (ACT 12), and then drive the separation mechanism 44 (ACT 13). In this case, the paper sheet S first becomes bent by the first bending roller 42 and the second bending roller 43. Then, the pickup roller 45 starts to carry the paper sheet S. Next, in order to easily carry the paper sheet S, the separation mechanism 44 separates the first bending roller 42 and the second bending roller 43 from the paper sheet S. Consequently, the paper sheet S returns to a state in which bending thereof is slight or the paper sheet S is not bent, and is then sent in the carrying direction X by the pickup roller 45.

Alternatively, the pickup roller 45 may be driven at the substantially same time as driving of the first bending roller 42 and the second bending roller 43. The pickup roller 45 may be driven at the substantially same time as driving of the separation mechanism 44. Such driving timings will now be described more in detail with reference to FIG. 7.

Figure 7:
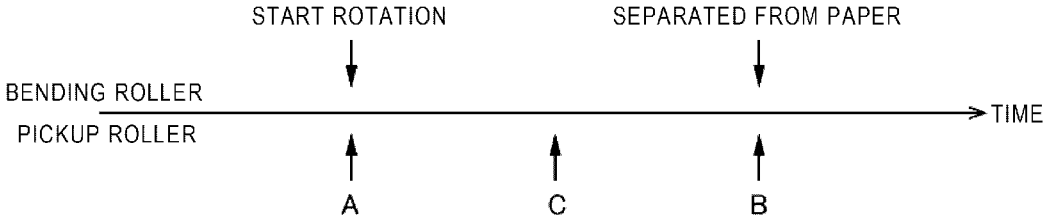
FIG. 7 is a sequence diagram illustrating operation timings of a driving roller and a pickup roller.

FIG. 7 is a sequence diagram of operation timings of the first bending roller 42, the second bending roller 43, and the pickup roller 45 according to the first embodiment. A transverse axis expresses time. Operations of the first bending roller 42 and the second bending roller 43 are illustrated on an upper part, and an operation of the pickup roller 45 is illustrated on a lower part.

The first bending roller 42 and the second bending roller 43 start rotation in a state of being located at the contact positions, and are separated from the paper sheet S by the separation mechanism 44 after a predetermined time elapses.

On the other hand, the pickup roller 45 may start rotation at any timing of A to C in FIG. 7. In other words, A indicates a case where the pickup roller 45 also starts rotation at the substantially same time as starting of rotation of the first bending roller 42 and the second bending roller 43. B indicates a case where the pickup roller 45 also starts rotation at the substantially same time as separation of the first bending roller 42 and the second bending roller 43 from the paper sheet S. C indicates a case where the pickup roller 45 starts rotation after the first bending roller 42 and the second bending roller 43 start rotation and before the first bending roller 42 and the second bending roller 43 are separated from the paper sheet S.

In other words, the pickup roller 45, and the first bending roller 42 and the second bending roller 43 are controlled so that the pickup roller 45 starts to be moved at the substantially same time as the first bending roller 42 and the second bending roller 43 starting to be moved or thereafter. The pickup roller 45 and the separation mechanism 44 are controlled so that the separation mechanism 44 separates the first bending roller 42 and the second bending roller 43 from the paper sheet S at the substantially same time as the pickup roller 45 starting to be moved or thereafter.

In the case A, the operation of bending the paper sheet S and the operation of carrying the paper sheet S are performed substantially simultaneously. In other words, the paper sheet S becomes bent by the first bending roller 42 and the second bending roller 43 and is also carried in the carrying direction X by the pickup roller 45. Thus, if a plurality of paper sheets S is required to be sequentially carried, carrying of the paper sheet S can be performed at a high speed.

In the case B, the pickup roller 45 starts rotation at the substantially same time as the paper sheet S returning to a state in which bending thereof is slight or the paper sheet S is not bent. In other words, in the case B, unlike in the case A, the paper sheet S whose bending is slight or which is not bent is carried by the pickup roller 45. Therefore, the case B is considerably advantageous if there is a probability that a wrinkle or a fold may be formed in the paper sheet S if the bent paper sheet S is to be immediately carried. For example, the case B is advantageous if a distance from the first bending roller 42 and the second bending roller 43 to the pickup roller 45 is short.

The case C is located between the case A and the case B. In the case C, a timing at which the pickup roller 45 starts rotation can be adjusted as appropriate so that speed and quality of paper carrying are balanced.

Although the cases A to C are described above, other cases are not intended to be excluded from targets of the present application. For example, the pickup roller 45 and the separation mechanism 44 may be controlled so that the pickup roller 45 starts rotation after the separation mechanism 44 separates the first bending roller 42 and the second bending roller 43 from the paper sheet S.

Hereinafter, a paper feeding method using the image forming apparatus 1 of the first embodiment will be described.

The paper feeding method of the first embodiment includes that a part of the paper sheet S accommodated in the paper feeding cassette 41 is moved by the first bending roller 42 and the second bending roller 43 in a direction intersecting the carrying direction X of the paper sheet S, and thus the paper sheet S becomes bent so that the paper sheet S is carried in the carrying direction X.

According to the paper feeding method, when the paper sheet S is carried, upper paper sheets S in the paper feeding cassette 41 become bent so as to be separated from each other in a stacking direction of the paper sheets S (a thickness direction of the paper sheet S). Therefore, according to the paper feeding method, it is possible to prevent a plurality of paper sheets S from being carried simultaneously due to static electricity, friction, and the like acting between the paper sheets S. This reduces a probability that multiple feeding of the paper sheets S may occur.

For example, the paper feeding method includes separating the first bending roller 42 and the second bending roller 43 from the paper sheet S after bending the paper sheet S. Consequently, static electricity between the paper sheets S can be removed by bending the paper sheet S, and then the paper sheet S can be easily carried after returning to a state in which bending thereof is slight or the paper sheet S is not bent.

Second Embodiment

Hereinafter, a description will be made of a configuration of the image forming apparatus 1 according to a second embodiment. A detailed description of the same constituent elements as in the first embodiment will be omitted.

Figure 8:
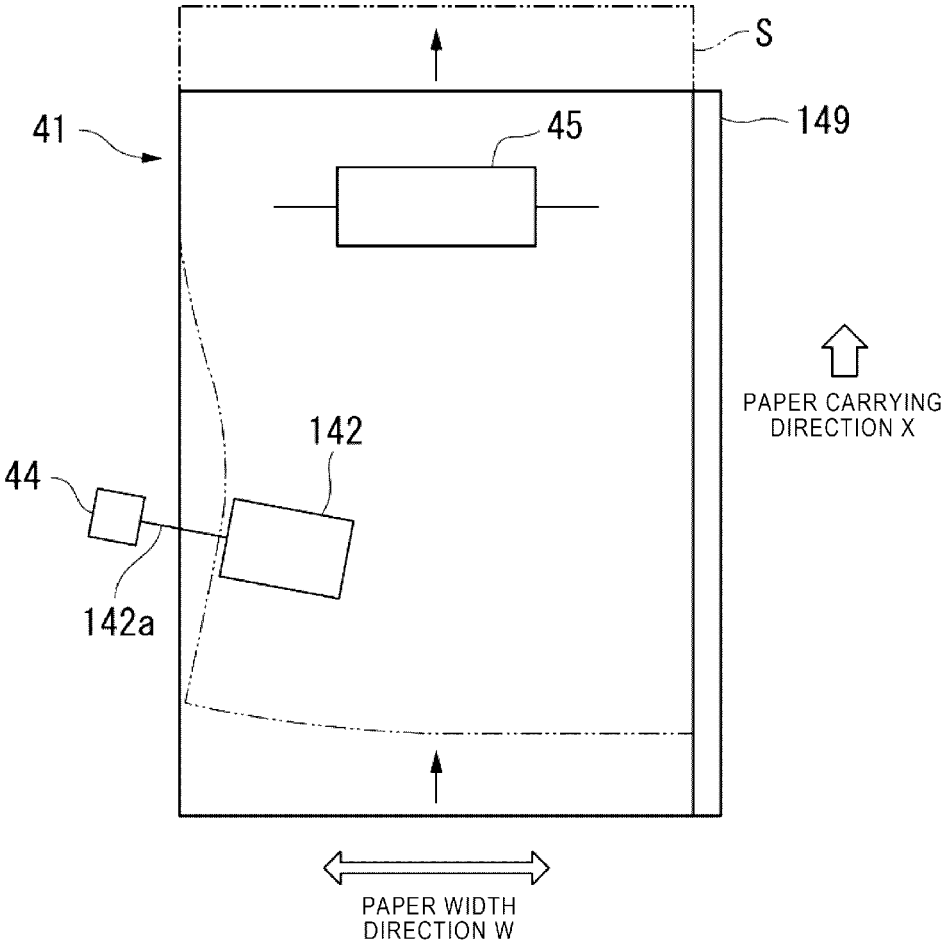
FIG. 8 is a plan view illustrating a paper feeding unit according to a second embodiment.

FIG. 8 is a plan view illustrating the paper feeding unit 13 according to the second embodiment.

The paper feeding unit 13 includes a paper feeding cassette 41, a paper feeding roller 47, a separation roller 48, a pickup roller 45, a bending roller 142, and a guide 149.

The paper feeding cassette 41, the paper feeding roller 47, the separation roller 48, and the pickup roller 45 are the same as those in the first embodiment.

In the second embodiment, the single bending roller 142 and the guide 149 are provided in the paper feeding unit 13 instead of the first bending roller 42 and the second bending roller 43 of the first embodiment. The bending roller 142 is an example of "at least one driving roller".

As illustrated in FIG. 8, the bending roller 142 is disposed so that a rotation direction of the bending roller 142 intersects the carrying direction X of the paper sheet S. In other words, the bending roller 142 is disposed so that a rotation shaft 142*a* of the bending roller 142 intersects the paper width direction W.

The rotation direction of the bending roller 142 intersects both the carrying direction X and the paper width direction W. Therefore, the bending roller 142 applies a force in the carrying direction X to the paper sheet S, and also applies a force directed toward the right side to the left half of the paper sheet S.

The guide 149 is in contact with the paper sheet S in the paper width direction W. The guide 149 supports a side (end) of the paper sheet S which is substantially parallel to the carrying direction X. Consequently, for example, the right end of the paper sheet S is restricted from being moved rightward by the guide 149. As a result, the paper sheet S becomes bent upward between the bending roller 142 and the guide 149.

As indicated by a dotted line in FIG. 8, the paper sheet S becomes bent upward by the bending roller 142 and the guide 149, and is then sent in the carrying direction X by the pickup roller 45. In other words, when the paper sheet S is carried, the uppermost paper sheet S in the paper feeding cassette 41 floats from another paper sheet S by the bending roller 142 and the guide 149. Therefore, the paper feeding unit 13 of the present embodiment can prevent a plurality of paper sheets S from being simultaneously carried due to static electricity, friction, or the like acting between the paper sheets S. This reduces a probability that multiple feeding of the paper sheets S may occur.

In the same manner as in the first embodiment, the bending roller 142 may be provided on the paper feeding cassette 41 in any arrangement as long as the bending roller bends a part of the paper sheet S.

A paper feeding method using the image forming apparatus 1 according to the second embodiment is the same as the paper feeding method of the first embodiment except that the paper sheet S is bent by a combination of the bending roller 142 and the guide 149 in FIG. 8.

Third Embodiment

Hereinafter, a description will be made of a configuration of the image forming apparatus 1 of a third embodiment. A detailed description of the same constituent elements as in the first embodiment or the second embodiment will be omitted.

Figure 9:
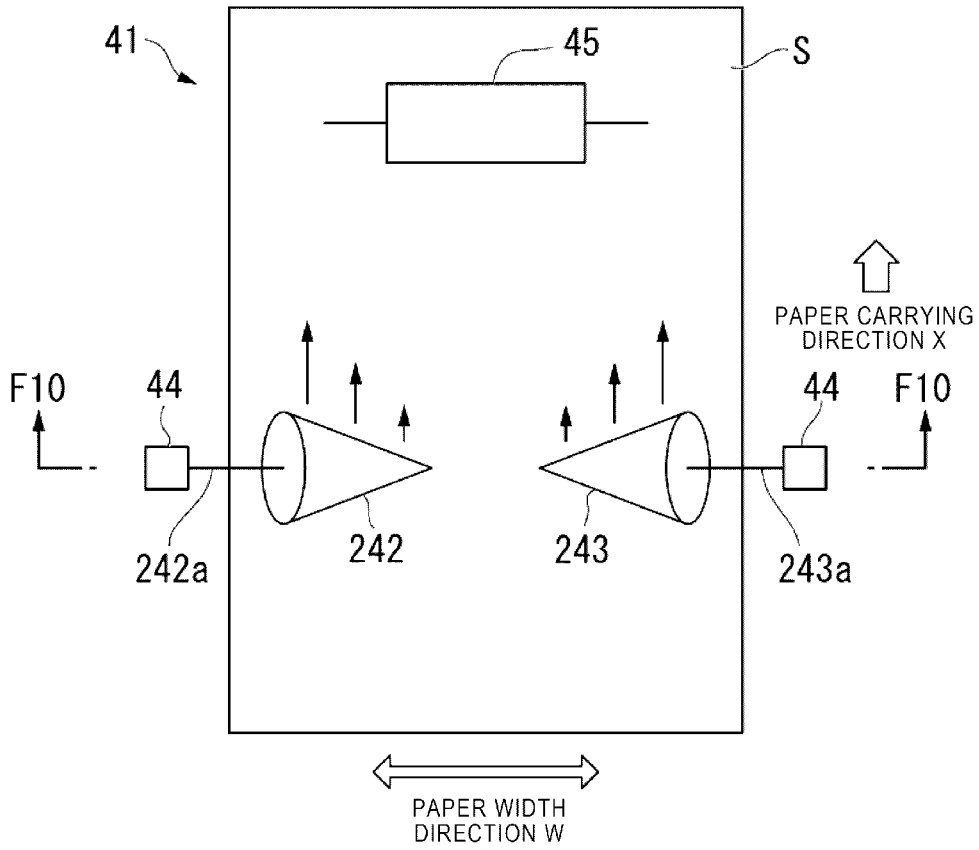
FIG. 9 is a plan view illustrating a paper feeding unit according to a third embodiment.
Figure 10:
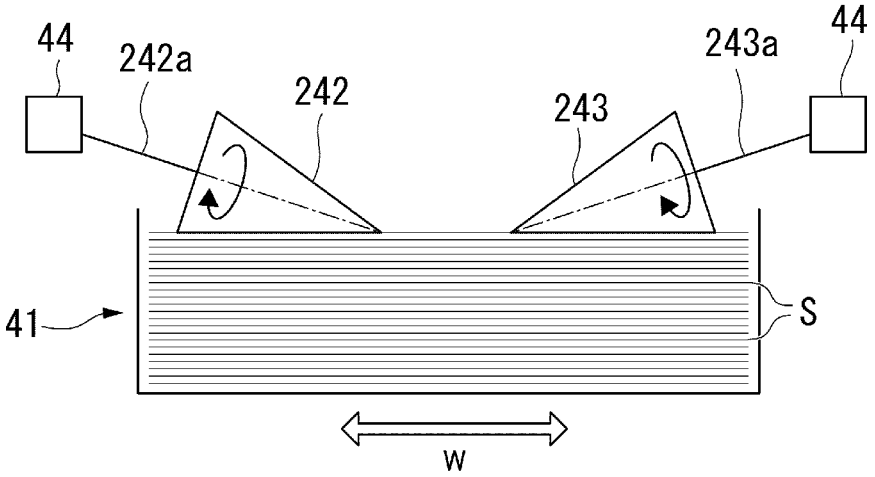
FIG. 10 is a sectional view taken along the F10-F10 line of the paper feeding unit in FIG. 9.

FIG. 9 is a plan view illustrating the paper feeding unit 13 according to the third embodiment. FIG. 10 is a sectional view illustrating the paper feeding unit 13 according to the third embodiment.

The paper feeding unit 13 includes a paper feeding cassette 41, a paper feeding roller 47, a separation roller 48, a pickup roller 45, a first bending roller 242, and a second bending roller 243.

The paper feeding cassette 41, the paper feeding roller 47, the separation roller 48, and the pickup roller 45 are the same as those in the first embodiment.

In the third embodiment, the conical first bending roller 242 and second bending roller 243 are provided in the paper feeding unit 13 unlike in the first embodiment and the second embodiment. The first bending roller 242 and the second bending roller 243 are examples of "at least one driving roller". The first bending roller 242 is an example of a "first roller". The second bending roller 243 is an example of a "second roller".

As illustrated in FIG. 10, the conical first bending roller 242 and second bending roller 243 are disposed so that circumferential surfaces of the first bending roller 242 and the second bending roller 243 come into contact with an upper surface of the paper sheet S. Thus, a rotation shaft 242*a* of the first bending roller 242 and a rotation shaft 243*a* of the second bending roller 243 intersect the upper surface of the paper sheet S. The rotation shaft 242*a* of the first bending roller 242 and the rotation shaft 243*a* of the second bending roller 243 also intersect the paper width direction W.

The first bending roller 242 and the second bending roller 243 come into contact with the uppermost paper sheet S when the paper sheet S is carried. The first bending roller 242 and the second bending roller 243 apply forces to the paper sheet S so that the paper sheet S is sent along rotation directions of the first bending roller 242 and the second bending roller 243.

When the first bending roller 242 and the second bending roller 243 are rotated, rotational angular velocities are the same as each other at a distal end and a basal end of each of the bending rollers 242 and 243. On the other hand, the distal end and the basal end of each of the bending rollers 242 and 243 have different radii, and thus speeds at which the paper sheet S is sent are different from each other. In other words, a movement distance of the paper sheet S sent by the basal end of each of the bending rollers 242 and 243 per predetermined time is longer than a movement distance of the paper sheet S sent by the distal end of each of the bending rollers 242 and 243 (refer to arrows in FIG. 9). Therefore, in FIG. 9, an outer part of the paper sheet S in the paper width direction W is sent in the carrying direction X faster than an inner part as a whole. As a result, a part of the paper sheet S becomes bent upward. In other words, when the paper sheet S is carried, the uppermost paper sheet S in the paper feeding cassette 41 floats from another paper sheet S by the first bending roller 242 and the second bending roller 243. Therefore, the paper feeding unit 13 of the present embodiment can prevent a plurality of paper sheets S from being simultaneously carried due to static electricity, friction, or the like acting between the paper sheets S. This reduces a probability that multiple feeding of the paper sheets S may occur.

In the same manner as in the first embodiment, the first bending roller 242 and the second bending roller 243 may be provided on the paper feeding cassette 41 in any arrangement as long as the bending rollers bend a part of the paper sheet S. For example, in FIG. 9, the rotation shaft 242*a* of the first bending roller 242 and the rotation shaft 243*a* of the second bending roller 243 are substantially perpendicular to the carrying direction X, but the rotation shafts 242*a* and 243*a* may be inclined not only with respect to the paper width direction W but also with respect to the carrying direction X. In the same manner as in the second embodiment, the second bending roller 243 may be omitted, and the guide 149 may be provided.

FIGS. 9 and 10 illustrate the conical bending rollers 242 and 243, but the first bending roller 242 and the second bending roller 243 may have a truncated-cone shape.

A paper feeding method using the image forming apparatus 1 of the third embodiment is the same as the paper feeding method of the first embodiment except that the paper sheet S is bent by the conical first bending roller 242 and second bending roller 243 in FIG. 9.

In any of the first to third embodiments, the bending rollers 42, 43, 142, 242 and 243 are disposed so that the rotation shafts 42*a*, 43*a*, 142*a*, 242*a* and 243*a* of the bending rollers 42, 43, 142, 242 and 243 intersect the paper width direction W. In other words, in the first and second embodiments in which the bending rollers 42, 43 and 142 have a cylindrical shape, the rotation shafts 42*a*, 43*a* and 142*a* of the bending rollers 42, 43 and 142 intersect the paper width direction W in a plane which is parallel to a paper surface. On the other hand, in the third embodiment in which the bending rollers 242 and 243 have a cone shape, the rotation shafts 242*a* and 243*a* of the bending rollers 242 and 243 intersect the paper width direction W in a plane which is perpendicular to a paper surface.

According to at least one of the above-described embodiments, the image forming apparatus includes at least one driving roller that is disposed contactably with a paper sheet and whose rotation direction with respect to the paper sheet at a contact part between the paper sheet and the roller intersects a carrying direction of the paper sheet, and can thus prevent a plurality of paper sheets from being carried simultaneously due to static electricity, friction, or the like acting between paper sheets. Consequently, it is possible to reduce a probability that multiple feeding of paper sheets may occur.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus comprising:

an accommodation unit configured to accommodate a paper sheet therein;

at least one driving roller configured to contact the paper sheet, wherein rotation of the driving roller while the driving roller is in contact with the paper sheet propels the paper sheet along a plane tangential to a contact position and coplanar with a carrying direction of the paper sheet;

a separation mechanism that moves the at least one driving roller out of the contact position to a separation position where the at least one driving roller is separated from the paper sheet; and a pickup roller that is disposed on a downstream side of the at least one driving roller in the carrying direction, wherein the at least one driving roller includes a first roller and a second roller, and the first roller and the second roller are disposed so that rotation shafts of the first roller and the second roller are separated from each other and are positioned such that a first vector normal to a curved surface of the first roller and a second vector normal to a curved surface of the second roller intersect on a downstream side of the rotation shafts with respect to the carrying direction.

2. The apparatus according to claim 1, wherein the at least one driving roller includes a first roller and a second roller, and the first roller and the second roller are disposed to be substantially symmetric to each other with respect to the carrying direction.

3. The apparatus according to claim 1, further comprising:

a control unit that controls the pickup roller so that the pickup roller starts moving at the substantially same time as the at least one driving roller starting to move or thereafter.

4. The apparatus according to claim 1, further comprising:

a control unit that controls the separation mechanism so that the at least one driving roller is separated from the paper sheet at the substantially same time as the pickup roller starting to move or thereafter.

5. The apparatus according to claim 1, further comprising:

the pickup roller disposed over the accommodation unit, wherein the pickup roller sends the paper sheet accommodated in the accommodation unit toward a paper feeding roller.

6. An image forming apparatus comprising:

an accommodation unit configured to accommodate a paper sheet therein; and at least one driving roller configured to be disposed contactably with the paper sheet and whose rotation shaft intersects a paper width direction which is substantially orthogonal to a carrying direction of the paper sheet;

a separation mechanism that moves the at least one driving roller between a contact position where the at least one driving roller comes into contact with the paper sheet and a separation position where the at least one driving roller is separated from the paper sheet; and a pickup roller that is disposed on a downstream side of the at least one driving roller in the carrying direction.

7. The apparatus according to claim 6, wherein the at least one driving roller includes a first roller and a second roller, and the first roller and the second roller are disposed to be substantially symmetric to each other with respect to the carrying direction.

8. The apparatus according to claim 6, wherein the at least one driving roller includes a first roller and a second roller, and the first roller and the second roller are disposed so that rotation shafts of the first roller and the second roller are separated from each other and are positioned such that a first vector normal to a curved surface of the first roller and a second vector normal to a curved surface of the second roller intersect on a downstream side of the rotation shafts with respect to the carrying direction.

9. The apparatus according to claim 6, further comprising:

a control unit that controls the pickup roller so that the pickup roller starts moving at the substantially same time as the at least one driving roller starting to move or thereafter.

10. The apparatus according to claim 6, further comprising:

a control unit that controls the separation mechanism so that the at least one driving roller is separated from the paper sheet at the substantially same time as the pickup roller starting to move or thereafter.

11. The apparatus according to claim 6, further comprising:

a pickup roller disposed over the accommodation unit, wherein the pickup roller sends the paper sheet accommodated in the accommodation unit toward a paper feeding roller.

12. A paper feeding method comprising:

bending a paper sheet by moving the paper sheet accommodated in an accommodation unit in a direction intersecting a carrying direction of the paper sheet with at least one driving roller; and carrying the paper sheet in the carrying direction;

moving the at least one driving roller between a contact position where the at least one driving roller comes into contact with the paper sheet and a separation position where the at least one driving roller is separated from the paper sheet, wherein a pickup roller is disposed on a downstream side of the at least one driving roller in the carrying direction.

13. The method according to claim 12, wherein the at least one driving roller is separated from the paper sheet after the paper sheet is bent.

14. The method according to claim 12, further comprising:

moving the pickup roller at the substantially same time or thereafter as the at least one driving roller.

15. The method according to claim 12, further comprising:

separating at least one driving roller from the paper sheet at the substantially same time as the pickup roller starting to move or thereafter.

16. The method according to claim 12, further comprising:

sending the paper sheet accommodated in the accommodation unit toward a paper feeding roller.

* * * * *